United States Patent [19]

Harpold

[11] Patent Number: 4,809,604

[45] Date of Patent: Mar. 7, 1989

[54] MACHINE FOR SCREEN PRINTING NUMBERS

[75] Inventor: Charles W. Harpold, Grand Rapids, Mich.

[73] Assignee: Harco Graphic Products, Inc., Grand Rapids, Mich.

[21] Appl. No.: 146,736

[22] Filed: Jan. 21, 1988

[51] Int. Cl.[4] ..... B41F 15/10; B41F 15/14

[52] U.S. Cl. ..... 101/115; 101/126; 101/DIG. 12; 33/614; 33/620

[58] Field of Search ..... 101/123, 114, 115, 126, 101/129, DIG. 12; 33/614, 620, 621

[56] References Cited

U.S. PATENT DOCUMENTS

| | | | |
|---|---|---|---|
| 2,026,377 | 12/1935 | Comstock | 33/620 |
| 2,369,602 | 2/1945 | Petty et al. | 101/114 |
| 3,104,475 | 9/1963 | Boeijinga | 33/620 |
| 4,111,118 | 9/1978 | Green et al. | 101/123 |
| 4,233,897 | 11/1980 | Lala | 101/123 |
| 4,583,458 | 4/1986 | Beachum | 101/126 |
| 4,649,815 | 3/1987 | Richardson | 101/126 |

OTHER PUBLICATIONS

"Harco Graphic Products, Inc. 1987 Equipment Catalog," p. 18.

"Garment Numbering Printer" Advertisement by M & M Research and Printing Aids.

"Garment Numbering Machine" Advertisement by Charlie Brown Company, Inc.

*Primary Examiner*—Clifford D. Crowder

*Attorney, Agent, or Firm*—Price, Heneveld, Cooper, DeWitt & Litton

[57] ABSTRACT

A numbering machine for use in the printing of numbers, wherein the machine includes a base, a carriage reciprocally mounted to the base, a platent pivotally mounted to the carriage for supporting material upon which the number will be printed, and a scale member provided with indicia which cooperates with the carriage for effecting proper positioning thereof. The scale member also provides indicia for indicating to the operator the proper pivotal orientation of the platen for its particular reciprocal positioning.

23 Claims, 4 Drawing Sheets

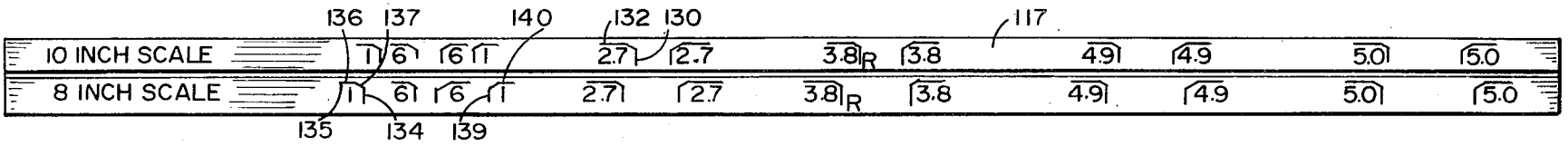
FIG. 6
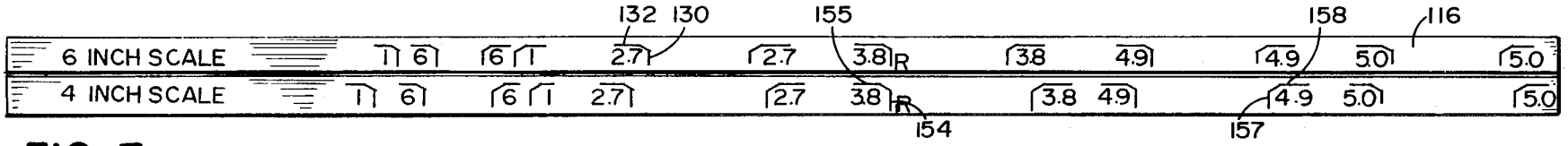
FIG. 7
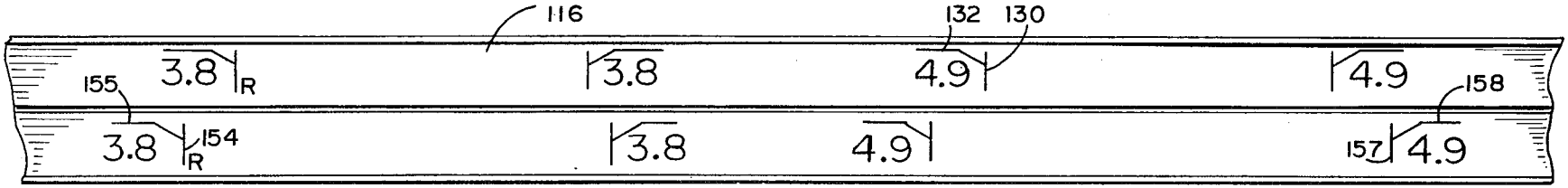
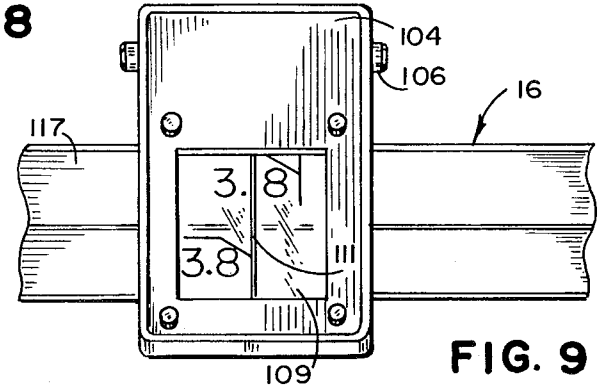
FIG. 8
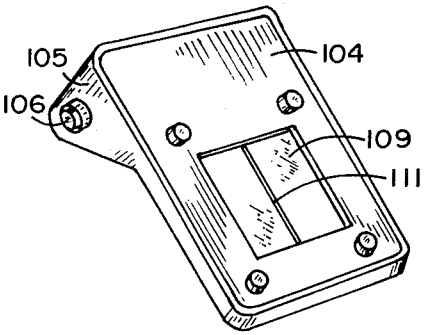
FIG. 9
FIG. 10

MACHINE FOR SCREEN PRINTING NUMBERS

BACKGROUND OF THE INVENTION

The present invention pertains to a numbering machine used in conjunction with the printing of numbers on jerseys, jackets and the like.

A simple printing numbering machine provided with upper printing screens and lower fixed platens may be utilized for the numbering process. The operator manually places the jersey on the platen and visually attempts to align and position the number properly thereon. The operator then lowers the screen and prints a number onto the material. To print a second digit of the number, the operator lifts the screen and again, manually adjusts the jersey in an attempt to properly position the second digit or character so that it is properly aligned and spaced in relation to the first digit of the number. Once the jersey has been visually aligned as well as possible, the operator lowers the screen once again and prints the second digit of the number.

In an effort to improve the efficiency of a printing numbering machine, past artisans have constructed such apparatus with movable platen assemblies. More specifically, to accommodate the printing of adjacent numerals, the use of a dual-faced platen in which the faces lie in different planes inclined to each other has been developed to avoid smearing of the first printed numeral. Such a platen assembly permits the platen to be adjusted so that only one face at a time is contacted by the printing screen. Also, such platen assemblies have been mounted upon a movable carriage so that the faces may be positioned beneath the appropriate numeral on the screen. Typically, the printing screens have been very large and included numerals zero through nine or the same numeral of all various sizes, or smaller screens with only one numeral of one size on each screen. The problem with very large screens containing ten digits is that they become unwieldy and difficult to clamp in place. The smaller screens place an undue burden on the operator to change the screens since only one numeral is one each screen.

One prior artisan has used a ten station rotary press in conjunction with a dual-faced platen as described above. A separate screen at each of the ten stations includes a single numeral. In order to print two color numerals, a two tiered rotary press is used, with ten stations on each tier. A ten station or twenty station rotary press is an exceptional item. Rotary presses typically comprise only four stations.

SUMMARY OF THE INVENTION

In the present invention, a unique numbering machine is provided which easily mounted to a conventional rotary printing machine or the like and ensures proper spacing and alignment in printing the two digits or characters of any number. The numbering machine includes a reciprocal carriage, a platen assembly pivotally mounted to the carriage, and a scale provided with indicia for effecting the proper pivotal orientation and longitudinal positioning of the platen assembly in relation with the printing screen.

The operator, by employing the numbering machine of the present invention, can achieve proper spacing and alignment of the characters of any two digit number printed upon a jersey, jacket or the like. The machine eliminates the guess work heretofore required in the spacing of such characters. Moreover, due to the provision of the scale member which directly indicates when the elements are properly positioned for the printing of the characters, the printing process is performed in a much quicker, more efficient, and easier manner tha with prior apparatus.

These and other objects, advantages and features of the present invention can be more fully understood and appreciated by reference to the detailed description of the preferred embodiment and the drawings.

BRIEF DESCRIPTION OF THE DRAWINGS

FIG. 4 is a front view of the carriage and platen assembly of the present invention;

FIG. 6 is a plan view of one face of the scale member of the present invention;

FIG. 7 is a plan view of a second face of the scale member of the present invention;

FIG. 8 is an enlarged partial view of FIG. 7;

FIG. 9 is an enlarged partial view of FIG. 7 with the addition of a cooperating marker plate;

FIG. 10 is a perspective view of the marker plate; and

DETAILED DESCRIPTION OF THE PREFERRED EMBODIMENT

Figure 1:
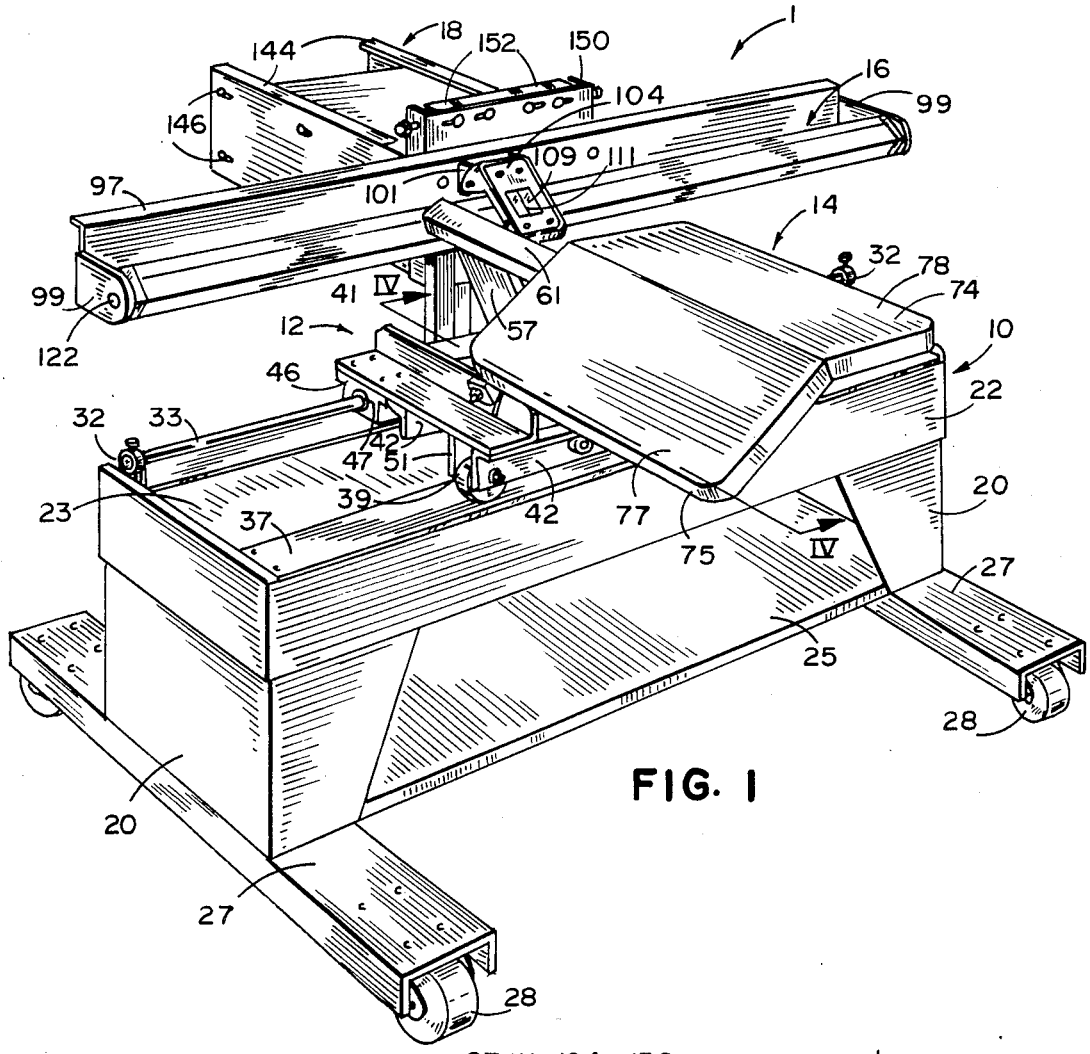
FIG. 1 is a perspective view of a numbering machine of the present invention.

In the preferred embodiment, numbering machine 1 (FIG. 1) comprises a base 10, a carriage 12, a platen assembly 14, a scale member 16, and a mounting structure 18. These parts cooperate such that numbering machiine 1 easily mounts to a conventional printing machine and automatically aligns and spaces the characters of two digit numbers being printed upon a jersey, jacket or the like.

As illustrated in FIG. 1, base 10 includes a pair of spaced-apart legs 20 which support an upper member 22 having a top surface 23. Preferably, legs 20 and upper member 22 are formed out of sheet metal with legs 20 being substantially U-shaped and received within and secured to the box-like structure of upper member 22. Positioned directly below upper member 22 is a shelf 25 upon which may be placed items related to the printing operation, such as ink. Base 10 is mounted upon a pair of spaced-apart feet 27. Each foot 27 is provided with a pair of spaced-apart rollers 28 which enhance the mobility of numbering machine 1, so that it may be easily moved with the printing machine or disconnected from the printing machien and moved to an alternate location so that the printing machine may perform other operations.

Mounted longitudinally, along top surface 23, adjacent the rearward side of base 10, is a bracket assembly 32 supporting a guide rod 33 (FIG. 1). Guide rod 33 extends substantially the entire length of top surface 23 and is designed to support and guide carriage 12. Parallel to guide rod 33 and extending substantially the entire length of top surface 23, adjacent the forward side of base 10 is a running strip 37 which receives thereupon rollers 39 of carriage 12. Running strip 37 functions to protect top surface 23 of base 10 from wear.

Figure 4:
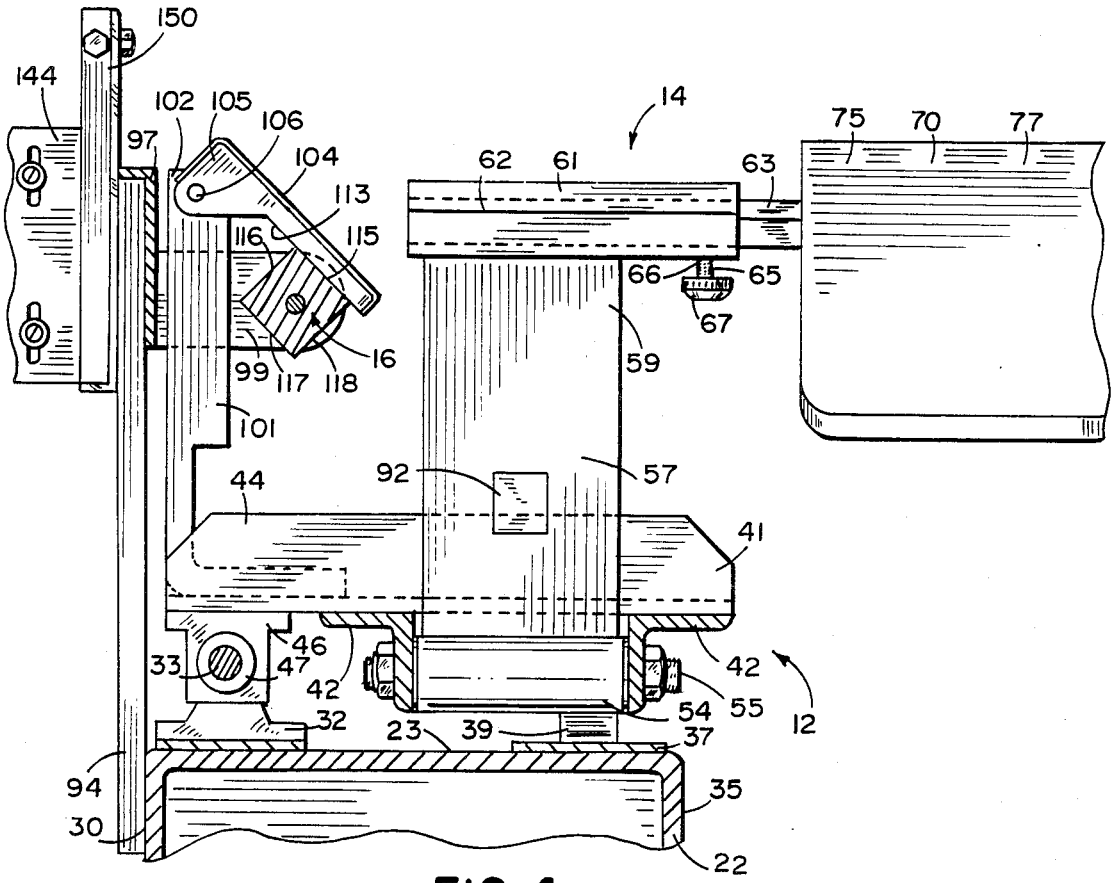
FIG. 4 is an enlarged cross-sectional view of the present invention taken along line IV—IV of FIG. 1.
Figure 5:
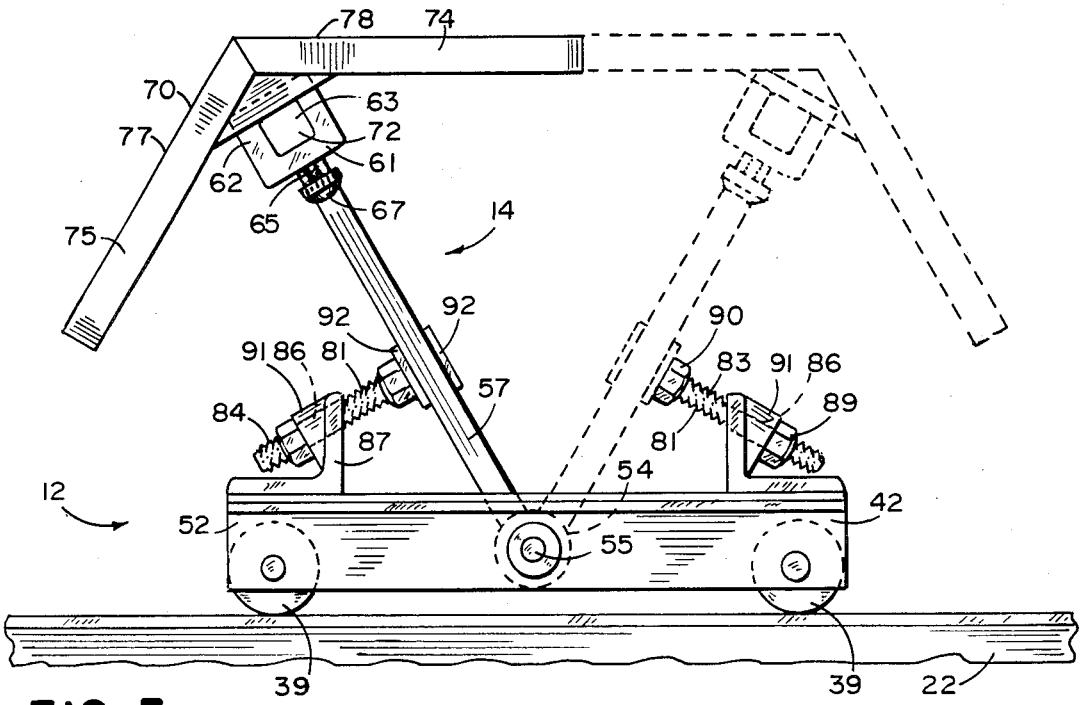

Mounted atop base 10 and cooperating with guide rod 33 and running strip 37 is carriage 12 (FIGS. 1, 4 and 5). Carriage 12 preferably includes a pair of transverse angle members 41 which extend across the width of top surface 23 and are interconnected by two longitudinal angle members 42. Extending downwardly from rearward end 44 of each transverse angle member 41 is a bearing block 46 having bearings 47 which are shaped and adapted to matingly and slidingly receive guide rod 33 therethrough.

Extending downwardly from the forward end of each transverse angle member 41 is a roller 39 which rollingly supports the forward end of carriage 12. As mentioned above, rollers 39 ride along running strip 37 so as to preclude premature wearing of top surface 23. In the preferred embodiment, rollers 39 are supported conventionally between flange 51 extending downwardly from tranverse angle member 41 and a downwardly projecting leg 52 of the longitudinal angle members 42.

Pivotally mounted centrally of carriage 12 is platen assembly 14 (FIGS. 4 and 5). Platen assembly 14 includes a lower hollow hub 54 which is positioned between longitudinal angle members 42. More specifically, hub 54 extends the entire distance between longitudinal angle members 42, and receives therethrough shaft 55 which pivotally mounts hub 54, and hence platen assembly 14, to carriage 12.

Extending upwardly from hub 54 is a rectangularly shaped body 57. Body 57 is fixedly mounted to hub 54, such as by welding, so that it too is pivotally movable relative to carriage 12. Supported on upper portion 59 of body 57 is a telescoping arm 61 which extends transversely to base 10. Arm 61 includes a female member 62 secured to body 57, and a male member 63 which is slidingly received in female member 62 and extends outwardly beyond the forward side of base 10. A set screw 65 is threadably received through bore 66 in a side of female member 62, to thereby lock male member 63 in its proper location. Knob 67 is provided on set screw 65 so that the operator may telescopingly adjust arm 61 quickly and easily. Telescoping arm 62, then, permits the operator to adjust the position of platen 70 to suit different printing machines and different printing operations.

Platen 70 is fixedly secured to the outer end 72 of male member 63, so that it too, pivots about shaft 55 mounted to carriage 12. Platen 70 is comprised of two plates 74, 75 angled with respect to one another and each having an upper face 77, 78. Preferably, first and second faces 77, 78 are positioned at about 10 to 50 degrees relative to each other.

As discussed earlier, platen assembly 14 is pivotally mounted to carriage 12. The pivoting action enables each face 77, 78 of platen 70 to be alternatively positioned in a horizontal plane. As illustrated in full lines in FIG. 5, platen assembly 14 may be pivoted to the left so that second face 78 is oriented horizontally; and as shown in phantom, platen assembly 14 may be pivoted to the right so that first face 77 may alternatively, also be oriented horizontally.

In order to set the precise amount of pivoting, so that each face 77, 78 is alternatively positoned in a horizontal orientation, stops 81 are provided on carriage 12 (FIG. 5). In the preferred embodiment, bolts 83, 84 are received through bores 86 in upwardly projecting legs 87 of transverse angle members 41. Nuts 89 are fixedly secured to protuberances 91 of legs 87, concentric to bores 86, to thereby threadedly receive bolts 83, 84 for adjustment purposes. Heads 90 of bolts 83, 84 abut body 57 of platen assembly 14 on wear plates 92, affixed to opposite sides of body 57, to set the operative positions of platen assembly 14.

In use, stop bolts 83, 84 are adjusted inwardly or outwardly to the precise position wherein faces 77, 78 may be alternatively oriented horizontally. More specifically, platen assembly 14 may be pivoted to the left about shaft 55 until it abuts stop bolt 84. At this position, second face 78 will be oriented horizontally and first face 77 will be oriented at an inclination from the horizontal (as seen in full lines in FIG. 5). Also, platen assembly 14 may be pivoted to the right until it abuts stop bolt 83. As seen in phantom in FIG. 5, this orientation of platen assembly 14 positions first face 77 in a horizontal plane, and second face 78 at an inclination to horizontal. As will be discussed further below, first and second faces 77, 78 are alternatively positioned in a horizontal orientation for the printing of the two different characters of the two digit number to be printed on the jersey.

Figure 2:
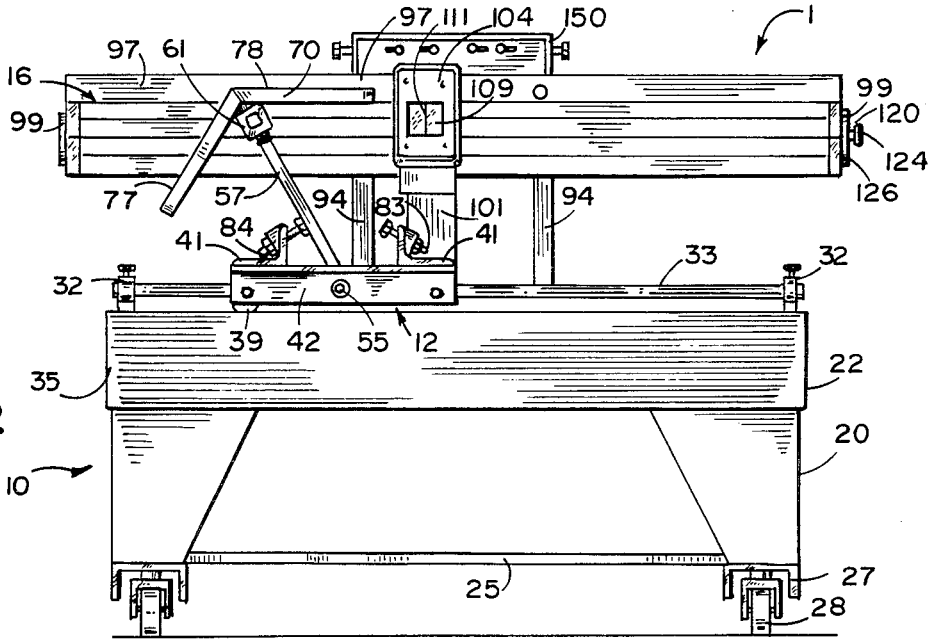
FIG. 2 is a front view of the present invention.
Figure 3:
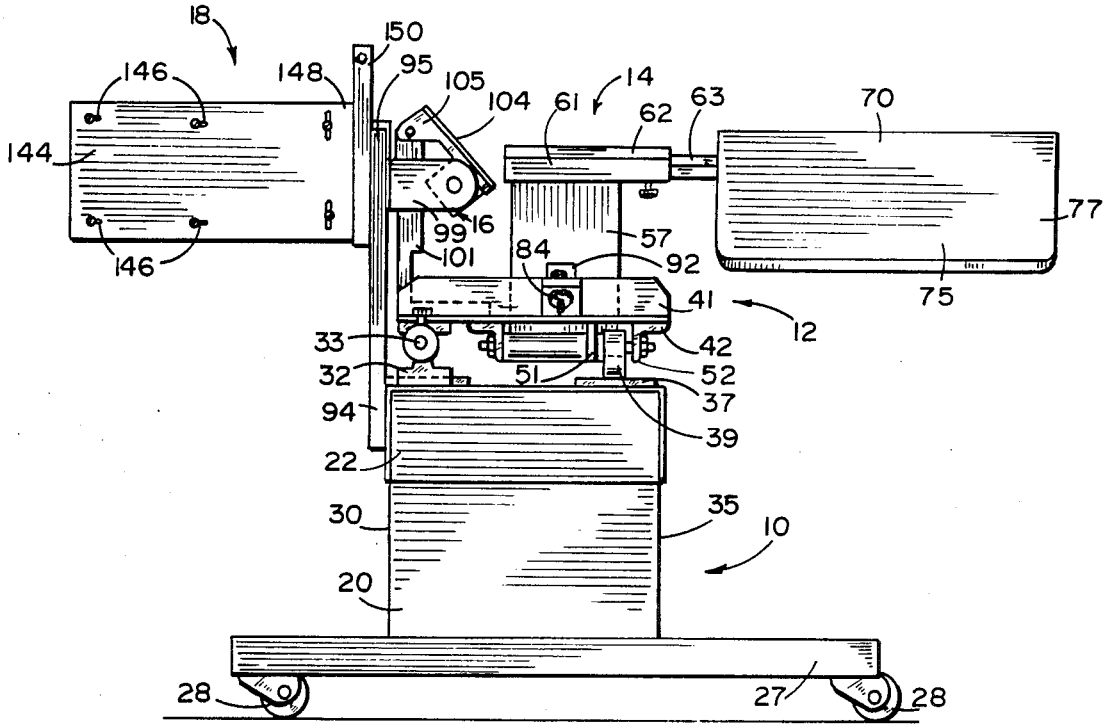
FIG. 3 is a side elevational vie of the present invention.

Attached to the rearward side of base 10 and projecting upwardly therefrom are a pair of vertical supports 94 (FIGS. 2, 3 and 4). Connected to the upper ends 95 of vertical supports 94 is a horizontal beam 97 which is dimensioned to extend substantially the entire length of base 10. Projecting forwardly from each end of beam 97 is a flange 99. Rotatably mounted between flanges 99, is a scale member 16 which also extends substantially the entire length of base 10. Scale member 16 is quadrangular in shape and is provided with four longitudinal faces 115–118. Along each face 115–118 is provided indicia setting forth at least one scale which is used to precisely position platen 70 for the proper spacing of the two digits to be printed on the jersey as will be further discussed below.

Attached to the rear end 44 of one transverse angle member 41 and extending upwardly therefrom is an upright member 101. The upper portion 102 of upright member 101 is positioned between beam 97 and scale member 16. Consequently, upper porton 102 of upright member 101 moves with carriage 14 between flanges 99 of beam 97. Pivotally attached to upper portion 102 is a marker plate 104. Marker plate 104 is provided with a pair of flanges 105 which straddle upper portion 102 and receive therethrough a pin 106 to thereby pivotally mount marker plate 104 to upright member 101. Marker plate 104 is also provided with a window 109 which includes thereacross, in a generally vertical direction, a mark or hair 111 (FIGS. 9 and 10).

The undersurface 113 of marker plate 104 is designed to ride along one face of scale member 16 (FIG. 4). Mark 111 cooperates with one of the scales printed on the face of scale member 16 engaging undersurface 113. In use, scale member 16 is positioned so that all of its faces 115–118 are oriented at a 45 degree angle to the horizontal. Since each face 115–118 of scale member 16 is provided with at least one different scale, machine 1 is structured so as to permit scale member 16 to rotate. This is accomplished by providing a locking arrangement 120 on one end of scale member 16 so as to hold scale member 16 in its operative position (FIG. 2). In the preferred embodiment, shaft 122, which rotatably mounts scale member 16 between flanges 99, extends outwardly beyond one flange 99 and is provided with a threaded end. Threadedly received onto the threaded end of shaft 122 is a knob 124, which may be easily grasped and turned so as to force flange 99 against end face 126 of scale member 16, to thereby lock scale member 16 in place. Of course, any known locking arrangement could be utilized.

Note that marker plate 104 rests against the operative face of scale member 16 solely through the use of gravity and will freely pivot upwardly when scale member 16 is rotated to its next operating position wherein a different face cooperates with marker plate 104.

The scales provided on faces 115–118 of scale member 16 are defined by indicia which function to precisely position and orient faces 77, 78 of platen 70 for the printing of a specific character to be printed upon the jersey or the like. The different scales are set-up to accommodate different sized numbers that may be used. Preferably, seven scales are provided and include scales for one, two, four, six, eight, ten and twelve inch numerals. For example: scales for one and two inch numerals are provided on face 115; scales for four and six inch numerals are provided on face 116; scales for eight and ten inch numerals are provided on face 117; and a scale for twelve inch numerals is provided on face 118 (FIGS. 4, 6, 7 and 8).

Referring to FIG. 6, face 117 is illustrated with scales for eight and ten inch numerals. Referring specifically to the eight inch scale, it is noted that several vertical lines 130 are provided along face 117 at various spacings. Adjacent each of these lines 130, sometimes in pairs, are the various numbers zero through nine.

In use, mark 111 of marker plate 104 is lined up with one of the vertical lines 130 in order to properly position platen 70 for the printing of a specific numeral. Positioned adjacent vertical lines 130 are angled lines 132. One end of each angled line 132 abuts one of the vertical lines 130 positioned across the face of scale member 16. These angled lines 132 function to guide the operator in choosing the correct vertical line 130 to use when platen assembly 14 is pivoted in a certain direction.

For example, mark 111 of marker plate 104 is aligned with line 134 when the operator desires to print a numeral one on the jersey portion supported by first face 77 of platen 70. As discussed previously, when platen assembly 14 is pivoted to the right, first face 77 of platen 70 is oriented in a horizontal position and second face 78 is angled downwardly therefrom. Angled line 135 intersecting line 134 stimulates this position of platen 70; that is, legs 136 and 137 of angled line 135 represent first face 77 and second face 78 of platen 70, respectively.

Likewise, when the operator desires to print a numeral one on the material supported by second face 78, he moves carriage 12 until mark 111 is aligned with line 139. Angled line 140 corresponding with vertical line 139, again, represents the position in which platen 70 should be placed; that is, when printing on the material supported by second face 78, platen assembly 14 is pivoted to the left, which orients second face 78 in a horizontal position with first face 77 extending downwardly at an angle thereto, just as is illustrated by angle line 140. The above described operation, then, would have printed the numeral eleven on the jersey, jacket, etc. In the same manner as with numeral one, all of the numerals are associated with similar vertical lines 130 and angled lines 132.

These scales are adapted to cooperate with screens (FIG. 11) which are utilized in conjunction with preferably rotary printing machines to print such numbers on jerseys, jackets and the like. Preferably, one screen will include the numbers one, two, three, four and five, and a second screen will include the numbers six, seven, eight, nine and zero. This accounts for the coupling of numbers on the same vertical line 130. More specifically, numbers two and seven, three and eight, four and nine, and five and zero are coupled together on the scale because they assume the same position on the two different screens and possess the same spacing characteristics. The numerals one and six are given different vertical lines 130 because the spacing for the numeral one is different than the spacing for the numeral six.

Each scale is correlated to the amount of horizontal movement which will be had when platen assembly 14 is pivoted from one side to the other and the amount of spacing. The spacings of lines 130 are predetermined in order to properly space apart the two characters of any two digit number. Hence, the specific spacings for lines 130 would vary depending upon various parameters, such as the length of body 57, the angle between the two faces 77, 78 of platen 70, the size of the numerals, the spacing of the numerals on the screens, etc.

Also secured to vertical supports 94 is a mounting structure 18 which includes two rearwardly extending channel members 144 (FIGS. 1 and 3). Channel members 144 are provided with a plurality of holes 146 which are positioned to align with holes provided in the printing machine. Note that holes 146 align with the same holes on the printing machine which are used to mount a conventional fixed platen. Holes 146 are generally elongated in order to facilitate some adjustment that may be necessary.

At the forward end 148 of channel members 144 is secured a guide structure 150 which projects upwardly therefrom. Guide structures 150 is provided with a pair of guide blocks 152 which receive a pin provided on the printing machine to be received therethrough. This ensures that proper alignment with the screens may be accomplished. Guide structure 150 may be adjusted vertically and guide blocks 152 may be adjusted horizontally, if necessary, in the mounting and set-up of numbering machine 1 to a printing machine. Note, however, that once these adjustments are set, during the mounting procedure, there is no further need to continually make these adjustments.

Also, as an adjustment in the set-up procedure, note that screens 222–225 are provided with a pair of guide marks 161, 162 positioned orthogonally to each other at a central portion of each screen. Guide marks 161, 162 are to be aligned with the centerline 166 of platen 70 and the rearward edge of the first face 77, respectively, when mark 111 is aligned on vertical line 164 (preferably marked with an "R") and platen assembly 14 is shifted to the right so that first face 77 is positioned in a horizontal plane. This arrangement allows the user to easily align the screens to be used in the mounts on the printers.

Figure 11:
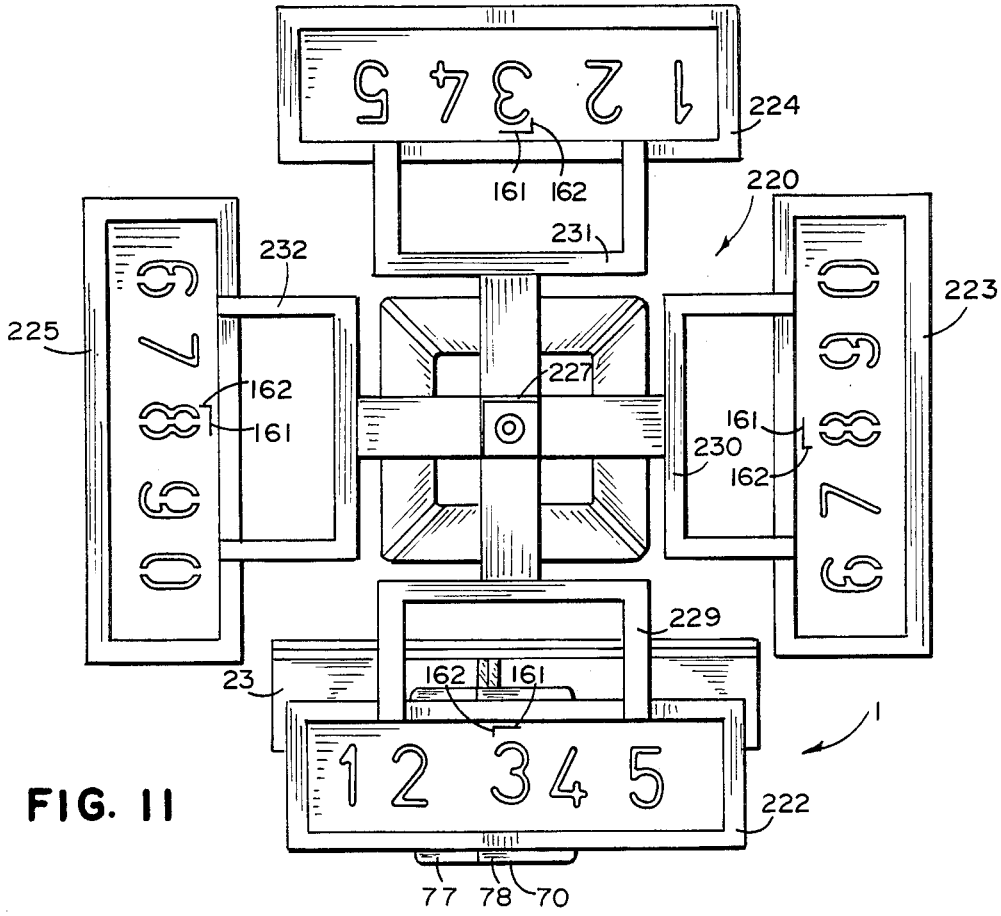
FIG. 11 is an illustrative plan view in which the numbering machine incorporates a rotary press.

In the preferred embodiment, numbering machine 1 is used in conjunction with a rotary printer 220. Typical rotary printers, such as printer 220, have four stations (FIG. 11). For printing very small numbers, all ten digits could be placed on a single screen. In such a situation, a rotary printer 220 could be set up for four color printing, when used in conjunction with the numbering machine 1 of the present invention. However, a far more common situation would involve somewhat larger numbers. Printing ten digits of numbers in excess of two (2) inches high on a single screen would result in a very bulky and unwieldy screen. One advantage of the present invention is that it can be used in conjunction with a rotary printer wherein five digits are placed on each screen. A rotary printer 220 typically includes a rotatable turret 227 which supports thereon four vertically reciprocal mounting stations 229–232 for mounting printing screens 222–225. In that manner, a conventional four station rotary printer such as printer 220 can be used for two color printing by using four separate five digit screens 222–225. One of the screens 222 would contain five digits to be printed in one color and another 223 would contain the other five digits to be printed in the same color. The third and fourth screens 224, 225 would each have five digits to be printed in the other color. The concept of using a rotary press in conjunction with the numbering machine of the present invention, and especially the use of that combination in conjunction with five digit screens, is an important aspect of the present invention.

In operation, the operator places and centers the back of a jersey, jacket, etc. upon platen 70. Locking arrangement 120 is then released so that scale member 16 may be rotated until the appropriate scale is positioned to underlie marker plate 104. For instance, if four inch numerals were to be printed on the back of a jersey or the like, scale member 16 would be rotated until face 116 (which includes the four inch scale) was positioned to engage undersurface 113 of marker plate 104. The operator would then tighten the locking arrangement 120 to preclude scale member 16 from inadvertently turning during the printing operation. Should the operator, then, desired to print the number thirty-nine, he would first position platen assembly 14 to the right (as seen in FIG. 5) so that first face 77 is oriented horizontally. The operator would move carriage 12 along top surface 23 until mark 111 is aligned with vertical line 154 which corresponds to the numeral three (FIGS. 7–9). Note, that angled line 155 corresponds to the position assumed by platen 70, and thereby informs the operator that he has chosen the correct vertical line for the platen face 77 on which he desires to print. The screen is then lowered and the numeral is printed upon the material in a well-known manner.

After the printing of numeral three, the screen is raised and the turret of the rotary press is rotated to position the screen having the numeral nine above platen assembly 14. The operator then pivots platen assembly 14 to the left, so that second face 78 is oriented horizontally and positioned for the printing of the numeral nine. The carriage is then moved to the right until mark 111 aligns with vertical line 157. Note that angled line 158 represents the position of platen 70 to again inform the operator that he has chosen the correct vertical line 157. The screen is then lowered upon platen 70 and the numeral nine is printed on the jersey, jacket, etc.

Of course, it is understood that the above are merely preferred embodiments of the invention, and that various other embodiments as well as many changes and alterations may be made without departing from the spirit and broader aspects of the invention as defined in the claims.

The embodiments of the invention in which an exclusive property or privilege is claimed are defined as follows:

1. A numbering machine for use in the printing of numbers from a screen containing a row of different numbers, wherein said machine comprises:

a base;

a carriage movably mounted on said base for movement in a line generally parallel to a screen containing a row of numbers associated with said numbering machine;

a platen having two adjacent faces oriented at a generally inverted "V" shaped angle relative to one another whereby one face of said platen can be oriented generally horizontally and the other angled downwardly away from said one face, said platen being pivotally mounted to said carriage whereby said other face can be pivoted into a generally horizontal position with said one face angling downwardly away therefrom;

a scale member mounted on said machine adjacent said carriage and in alignment with the path of movement of said carriage whereby said carriage can be moved along the length of said scale member, said scale member including two sets of indicia along its length;

said carriage including a marker movable therewith for alignment with different ones of said indicia along the length of said scale member;

a first set of said indicia including two numbers on a printing screen associated with said machine, with said numbers located at positions along said scale member in accordance with a first scale whereby when said platen is in position with said one face generally horizontally oriented, location of said carriage with said marker adjacent an indicia for a given number will align said one face of said platen such that the corresponding number on said screen will be printed on an article placed on said platen; and said second set of indicia being located along the length of said scale member in accordance with said scale, and including the same numbers as said first scale and located so that when said platen is pivoted to the position with said other face oriented generally horizontally, location of said carriage with said marker adjacent an indicia of said second set for a given number will align said other face of said platen such that the corresponding number will be printed from said screen onto an article placed on seaid platen whereby two numbers can be printed directly adjacent one another on an article placed on said platen.

2. The numbering machine of claim 1 in which each said set of indicia includes a plurality of lines, corresponding with said numbers, spaced apart with a predetermined distance such that the proper spacing between any two adjacent numbers printed on an article is obtained by aligning said marker with the appropriate line on said scale member.

3. The numbering machine of claim 2 in which each said set of indicia further includes graphic representations of said platen orientation associated with each said line given for said numbers, whereby said platen faces can be properly positioned longitudinally and pivotally by visual observation of said indicia on said scale member.

4. The numbering machine of claim 3 in which said graphic representations include a pair of lines oriented in a generally V-shaped configuration wherein graphic representations associated with said first set of indicia have one line positioned horizontally to represent the proper orientation of said platen when said marker is positioned adjacent the given indicia of said first set, and wherein graphic representations associated with said second set have the other line positioned horizontally to represent the proper orientation of said platen when said marker is positioned adjacent the given indicia of said second set.

5. The numbering machine of claim 1 in which each said set of indicia further includes graphic representations of said platen orientation associated with each said line given for said numbers, whereby said platen faces can be properly positioned longitudinally and pivotally by visual observation of said indicia on said scale member.

6. The numbering machine of claim 5 in which said graphic representations include a pair of lines oriented in a generally inverted V-shaped configuration wherein graphic representations associated with said first set of indicia have one line positioned horizontally to represent the proper orientation of said platen when said marker is positioned adjacent a given indicia of said first set, and wherein graphic representations associated with said second set have the other line positioned horizontally to represent the proper orientation of said platen when said marker is positioned adjacent a given indicia of said second set.

7. The numbering machine of claim 1 in which said scale member is rotatably mounted to said machine and is provided with a plurality of surfaces, each surface having thereon at least one collection of corresponding first and second sets of indicia in accordance with a scale for a predetermined size of number, whereby said scale member may be rotated to position the desired surface in operative association with said marker.

8. The numbering machine of claim 1 comprising at least two screens, each said screen including five numbers of a ten number range of zero through nine, one screen including the numbers one through five and the other screen including the numbers six through nine and zero; and each said set of indicia including the ten numbers zero through nine, and six different indicia locations, wherein at least one of said six locations is associated with two different numbers, one of said two different numbers being provided on one of said screens and the other of said two different numbers being provided on another of said screens, whereby at least two different numbers may be printed at the same platen location.

9. The numbering machine of claim 8 in which said six different indicia locations include one location associated with the number one, a second location associated with the number six, a third location associated with the numbers two and seven, a fourth location associated with the numbers three and eight, a fifth location associated with the numbers four and nine, and a sixth location associated with the numbers five and zero, whereby any two digit number can be printed through the use of two screens used in cooperation with said six indicia locations of each set of indicia.

10. The numbering machine of claim 1 in which said scale member includes screen aligning indicia which functions to cooperate with indicia on said screen such that when said marker is aligned with said screen aligning indicia, said screen can be properly positioned by aligning said indicia on said screen with the intersection of said faces of said platen.

11. A numbering assembly for use in the printing of numbers from at least one screen which contains a row of different numbers comprising:

a rotatable turret having at least one station having means for supporting said screen; and a numbering machine which includes:

a carriage movably mounted on said machine for movement in a line generally parallel to said screen and a platen mounted on said carriage and having two adjacent faces oriented at a generally inverted "V" shaped angle relative to one another whereby one face of said platen can be oriented generally horizontally and the other angled downwardly away from said one face, said platen being pivotally mounted to said carriage whereby said other face can be pivoted into a generally horizontal position with said one face angling downardly away therefrom;

a scale member mounted on said machine; and a marker associated with said platen to cooperate with said scale member;

said scale member includes first and second sets of indicia;

said first set of indicia includes the numbers on a printing screen associated with said machine, with said numbers located at positions along said scale member in accordance with a first scale whereby when said platen is in position with said one face generally horizontally oriented, location of said carriage with said marker adjacent an indicia for a given number will align said one face of said platen such that the corresponding number on said screen will be printed on an article placed on said platen; and said second set of indicia being located along the length of said scale member in accordance with said scale, and including the same numbers as said first scale and located so that when said platen is pivoted to the position with said other face oriented generally horizontally, location of said carriage with said marker adjacent an indicia of said second set for a given number will align said other face of said platen such that the corresponding number will be printed from said screen onto an article placed on said platen whereby two numbers can be printed directly adjacent one another on an article placed on said platen.

12. The numbering assembly of claim 11 in which:

said rotary press includes at least two stations mounted on said turret, each station supporting one screen, said stations being alternatively positioned directly above said numbering machine;

each said screen includes five numbers of a ten number range of zero through nine, and that two screens are used in conjunction with said machine, one screen including the numbers one through five and the other screen including the numbers six through nine and zero; and each said set of indicia includes the ten numbers zero through nine, and six different indicia locations, one location associated with the number one, a second location associated with the number six, a third location associated with the numbers two and second, a fourth location associated with the numbers three and eight, a fifth location associated with the numbers four and nine, and a sixth location associated with the numbers five and zero, whereby any two digit number can be printed through the use of two screens used in cooperation with said six indicia locations of each set of indicia.

13. The numbering assembly of claim 12 in which said rotary press includes four stations mounted on said turret whereby two color printing can be accomplished on an article for any two digit number without the need to change any screens during the printing operation.

14. The numbering assembly of claim 12 in which said rotary press includes four stations mounted on said turret, and in which said scale member is rotatably mounted to said machine and is provided with a plurality of surfaces, each surface having thereon at least one collection of corresponding first and second sets of indicia in accordance with a scale for a predetermined size of number, whereby said scale member may be rotated to position the desired surface in operative association with said marker and whereby two sizes of numbers can be printed on an article without having to change any of the screens or the scale member during the printing operation.

15. The numbering assembly of claim 11 in which said scale member includes a screen alinging indicia which functions to cooperate with indicia on said screen such that when said marker is aligned with said screen aligning indicia that said screen can be properly positioned by aligning said indicia on said screen with the intersection of said faces of said platen.

16. A numbering machine for use in the printing of numbers from a screen containing a row of different numbers onto an article, wherein said machine comprises:

a platen mounted for movement longitudinally parallel to said row of numbers and having two adjacent faces oriented at a generally inverted "V" shaped angle relative to one another whereby one face of said platen can be oriented generally horizontally and theother angled downwardly away from said one face for the printing of a number on said article on said one face, said platen being pivotally mounted whereby said other face can be pivoted into a generally horizontal position with said one face angling downwardly away therefrom for the printing of a number on said article on said other face;

a scale member mounted on said machine; and a marker associated with said platen to cooperate with said scale member;

said scale member includes:

an elongated body having at least one face;

said face having printed thereon first and second sets of indicia;

said first set of indicia includes the numbers zero through nine, with said numbers located at positions along said scale member in accordance with a first scale used for locating said platen in a proper position for the printing of a given number as the first digit of a two digit number;

said second set of indicia being located along the length of said scale member in accordance with said scale, and including the same numbers as said first set of indicia and located to position said platen in a location for the printing of a given number as the second digit of a two digit number;

each said set of indicia further including a plurality of lines, wherein one of said lines is associated with each said number, said lines are spaced apart a predetermined distance such that the proper spacing between any two adjacent digits printed on an article is obtained by aligning said marker with the appropriate line; and each said set further includes a plurality of graphic representations of said platen orientation, wherein one of said graphic orientations is associated with each said line for each said number, whereby said platen can be properly located and oriented by visual observation of said indicia on said scale member.

17. The scale member of claim 16 in which each said graphic representation includes a pair of lines oriented in a generally inverted V-shaped configuration to represent the shape of said platen, wherein graphic representations associated with said first set of indicia have one line positioned horizontally to represent the proper orientation of said platen when said marker is positioned adjacent a given indicia of said first set, and wherein graphic representations associated with said second set have the other line positioned horizontally to represent the proper orientation of said platen when said marker is positioned adjacent a given indicia of said second set.

18. A scale member for use with a numbering machine having a platen for receiving an article for the printing of a two digit number thereon and a marker associated with said platen for cooperating with said scale member, wherein said scale member comprises:

an elongated body having at least one face;

said face having printed thereon first and second sets of indicia;

said first set of indicia includes the numbers zero through nine, with said numbers located at positions along said scale member in accordance with a first scale used for locating said platen in a proper position for the printing of a given number as the first digit of a two digit number;

said second set of indicia being located along the length of said scale member in accordance with said scale, and including the same numbers as said first set of indicia and located to position said platen in a location for the printing of a given number as the second digit of a two digit number;

each said set of indicia further including a plurality of lines, wherein one of said lines is associated with each said number, said lines are spaced apart a predetermined distance such that the proper spacing between any two adjacent digits printed on an article is obtained by aligning said marker with the appropriate line; and each said set further includes a plurality of graphic representations of said platen orientation, wherein one of said graphic orientations is associated with each said line for each said number, whereby said platen can be properly located and oriented by visual observation of said indicia on said scale member.

19. The scale member of claim 18 in which each said graphic representation includes a pair of lines oriented in a generally inverted V-shaped configuration to represent the shape of said platen, wherein graphic representations associated with said first set of indicia have one line positioned horizontally to represent the proper orientation of said platen when said marker is positioned adjacent a given indicia of said first set, and wherein graphic representations associated with said second set have the other line positioned horizontally to represent the proper orientation of said platen when said marker is positioned adjacent a given indicia of said second set.

20. The scale member of claim 18 in which said scale member is further provided with a plurality of faces, each face having thereon at least one collection of corresponding first and second sets of indicia in accordance with a scale for a predetermined size of number, whereby said scale member may be used to position the printing of numbers of various sizes.

21. The scale member of claim 18 wherein each set of indicia includes the ten numbers zero through nine, and six different indicia locations, wherein at least one of said six locations is associated with two different numbers, whereby said scale member cooperates with two different screens such that at least two different numbers may be printed at the same platen location.

22. The scale member of claim 21 in which said six different indicia locations include one location associated with the number one, a second location associated with the number six, a third location associated with the numbers two and seven, a fourth location associated with the numbers three and eight, a fifth location associated with the numbers four and nine, and a sixth location associated with the numbers five and zero, whereby any two digit number can be printed through the use of two screens used in cooperation with said six indicia locations of each set of indicia.

23. A numbering machine for use in the printing of numbers from a screen containing a row of different numbers, wherein said machine comprises:

a platen movably mounted on said machine, having two adjacent faces oriented in a non-planar relationship with each other, whereby each platen face may be alternatively oriented in an operative position;

a scale member rotatably mounted to said machine and including a plurality of faces, each said scale face having printed thereon first and second sets of indicia;

means associated with said platen for aligning with said indicia on said scale member for determining proper location for said platen;

said first set of indicia provided on each of said scale faces includes the numbers on a printing screen associated with said machine, with said numbers located at positions along said scale member in accordance with a scale, wherein the scales provided on each scale face are different to facilitate the printing of different sized numbers, whereby when said platen is in one position with one said platen face being positioned in an operative orientation, said platen location is determined by aligning said aligning means with an indicia adjacent a given number which will align said one platen face such that the corresponding number on said screen will be printed on an article placed on said platen; and said second sets of indicia provided on each of said scale faces includes the same numbers as said first sets, with said numbers located along said scale member in accordance with scales corresponding with said first sets, whereby when said platen is in another orientation with the other said platen face being positioned in the operative position, the location of said platen is determined by aligning said aligning means with an indicia adjacent a given number which will align said other platen face such that the corresponding number on said screen will be printed on an article placed on said platen, whereby two numbers can be printed directly adjacent one another on an article placed on said platen.

* * * * *

UNITED STATES PATENT AND TRADEMARK OFFICE

CERTIFICATE OF CORRECTION

PATENT NO. : 4,809,604

DATED : March 7, 1989

INVENTOR(S) : Charles W. Harpold

It is certified that error appears in the above-identified patent and that said Letters Patent is hereby corrected as shown below:

Column 1, line 42:

"one" should be --on--.

Column 1, line 54:

"mounted" should be --mounts--.

Column 2, line 4:

"tha" should be --than--.

Column 2, line 15:

"vie" should be --view--.

Column 2, line 19:

"Fig. 4" should be --Fig. 5--.

Column 2, line 56:

"machien" should be --machine--.

Column 7, line 30:

"desired" should be --desire--.

Column 8, claim 1, line 21:

"two" should be --the--.

UNITED STATES PATENT AND TRADEMARK OFFICE

CERTIFICATE OF CORRECTION

PATENT NO. : 4,809,604

DATED : March 7, 1989

INVENTOR(S) : Charles W. Harpold

It is certified that error appears in the above-identified patent and that said Letters Patent is hereby corrected as shown below:

Column 8, claim 1, line 42:

"seaid" should be --said--.

Column 11, claim 15, line 17:

"alinging" should be --aligning--.

Column 11, claim 16, line 32:

"theother" should be --the other--.

Signed and Sealed this

Thirteenth Day of March, 1990

*Attest:*

JEFFREY M. SAMUELS

*Attesting Officer*

*Acting Commissioner of Patents and Trademarks*